United States Patent [19]

Ogawa

[11] Patent Number: 5,069,150

[45] Date of Patent: Dec. 3, 1991

[54] SEWING MACHINE FOR AUTOMATIC THREAD TAKING-UP OPERATION

[75] Inventor: Masao Ogawa, Nagoya, Japan

[73] Assignee: Brother Kogyo Kabushiki Kaisha, Japan

[21] Appl. No.: 594,038

[22] Filed: Oct. 9, 1990

[30] Foreign Application Priority Data

Oct. 13, 1989 [JP] Japan ..... 1-266677

[51] Int. Cl.[5] ..... D05B 49/00

[52] U.S. Cl. ..... 112/241; 112/302

[58] Field of Search ..... 112/241, 225, 302, 242, 112/243, 244, 245, 246, 247, 57, 96

[56] References Cited

U.S. PATENT DOCUMENTS

| | | | |
|---|---|---|---|
| 3,561,002 | 2/1971 | Robert | 112/241 |
| 4,006,699 | 2/1977 | Matsuda | 112/241 |
| 4,030,431 | 6/1977 | Martin et al. | 112/241 |
| 4,651,660 | 3/1987 | Oshima et al. | 112/241 X |
| 4,917,033 | 4/1990 | Satoma | 112/302 |

FOREIGN PATENT DOCUMENTS

| | | |
|---|---|---|
| 47-19948 | 9/1972 | Japan . |
| 54-43878 | 12/1979 | Japan . |
| 56-27900 | 7/1981 | Japan . |
| 63-228 | 1/1988 | Japan . |

*Primary Examiner*—Peter Nerbun

*Attorney, Agent, or Firm*—Oliff & Berridge

[57] ABSTRACT

A sewing machine including an automatic thread taking-up operation which comprises an arm of a thread take-up projecting beyond a thread holding member, a needle thread carrying member for introducing the needle thread into the thread holding member when the thread take-up swings toward one end of a thread guide, a pathway for the needle thread formed in the thread holding member, a blocking member for preventing the needle thread from slipping out of the thread holding member, and a crossing member for helping the needle thread carried beyond the thread taking-up member to cross the thread guide. The sewing machine can easily perform thread taking-up operation and threading operation while the thread take-up swings vertically.

20 Claims, 10 Drawing Sheets

SEWING MACHINE FOR AUTOMATIC THREAD TAKING-UP OPERATION

BACKGROUND OF THE INVENTION

The present invention relates to a sewing machine for automatic thread taking-up operation. More specifically, this invention relates to a sewing machine that can automatically take up a needle thread using a thread take-up prior to any sewing operation.

Currently proposed sewing machines can simplify the thread taking-up operation of a needle thread with a thread take-up (hereafter referred to as thread taking-up operation) prior to sewing operation. For example, in sewing machines disclosed in Japan Published Examined Utility Model Application No. S56-27900 and U.S. Pat. No. 3,561,002, a thread take-up is surrounded with a cover provided with a slit. When an operator guides a needle thread along the slit, the needle thread is put on an end of the thread take-up. Subsequently, the thread take-up swings up and the needle thread is caught by the end of the thread take-up. The needle thread is thus taken up. Although the thread take-up has to be in a lower position in these sewing machines, the thread take-up is generally raised up together with the needle bar when the sewing machine is stopped. Therefore, the operator has to lower the thread take-up before guiding the needle thread along the slit.

Japan Published Unexamined Patent Application No. S47-19948 and Japan Published Examined Utility Model Application No. S63-228 propose sewing machines that can automatically perform the thread taking-up operation without lowering the raised thread take-up in advance. In these prior art devices, thread positioning members for stringing a needle thread are provided in the moving area of the thread take-up. The needle thread is not slackened when the thread take-up swings down and pushes away the needle thread. An operator hangs the needle thread on the thread positioning members such that the needle thread is strung with appropriate tension and then swing the thread take-up up and down.

In a general sewing machine, however, the needle thread must be caught by both a thread taking-up member and a thread take-up in a prescribed order. This is a troublesome operation. In addition, the needle thread has to be taken up by the thread taking-up member and the thread take-up with suitable tensile strength such that uneven stitches are prevented at the beginning of the sewing operation.

In prior-art sewing machines, the operator must put the needle thread on the thread taking-up member. Furthermore, some operations are required for the thread taking-up operation. For example, the thread take-up must be lowered, the needle thread must be securely held by the thread positioning member, and so on. Thus, the thread taking-up operation cannot be automatically executed to the full extent desirable and complicated operations for preparing the needle thread are necessary.

Wherefore, an object of this invention is to provide a sewing machine for automatically taking-up a needle thread with a thread take-up and a thread taking-up member.

Other objects and benefits of the invention will become apparent from the detailed description which follows hereinafter when taken in conjunction with the drawing figures which accompany it.

SUMMARY OF THE INVENTION

To attain this object, the sewing machine for automatic thread taking-up operation of this invention that can perform the thread taking-up operation has a thread taking-up member provided at one end of a thread guide and a thread holding member carried at an end of a thread take-up in a swinging operation of the thread take-up, which comprises a projecting member provided in the thread take-up and projecting beyond the thread holding member, a needle thread carrying member for introducing the needle thread into the thread holding member when the thread take-up swings toward an opposite end of the thread guide and the needle thread intersecting the thread guide abuts the projecting member, a pathway formed in the thread holding member through which the needle thread enters the thread holding member, a blocking member for preventing the needle thread having entered the thread holding member through the space from slipping out of the thread holding member, and an crossing member for helping the needle thread carried beyond the thread taking-up member to cross the thread guide.

In the sewing machine for automatic thread taking-up operation of the present invention, when the thread take-up swings down, the needle thread carrying member makes the projecting member provided at the end of the thread take-up abut the needle thread intersecting the moving area of the thread take-up and carries the needle thread beyond the thread taking-up member. Then, the crossing member helps the needle thread having been carried beyond the thread taking-up member to cross the thread guide. Thus, the needle thread is caught by the thread taking-up member.

At the same time, the thread carrying member leads the needle thread abutting the projecting member to the thread holding member of the thread take-up through a pathway. The blocking member prevents the needle thread introduced to the thread holding member from going out of the thread holding member. As described above, in the sewing machine for automatic thread taking-up operation of this invention, the needle thread is taken up by the thread taking-up member provided at one end of the thread guide and the thread holding member carried at an end of the thread take-up in a swinging operation of the thread take-up.

DETAILED DESCRIPTION OF THE PREFERRED EMBODIMENTS

Sewing machines including an automatic thread taking-up operation embodying the present invention are described in detail with reference to the attached drawings. The sewing machine can also automatically perform a threading operation.

Figure 1:
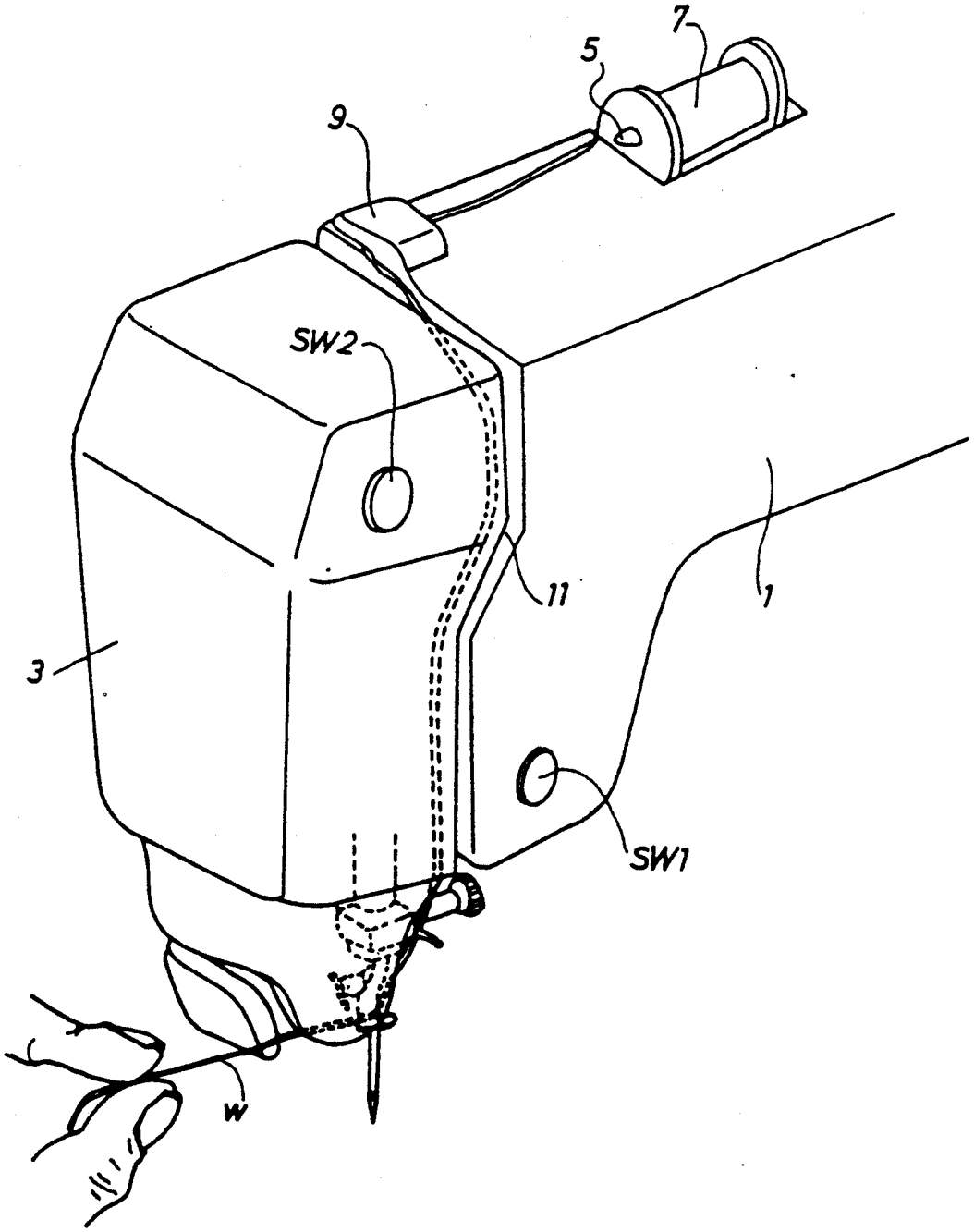
FIG. 1 is a perspective view showing a sewing machine for automatic thread taking-up operation according to this invention in a first embodiment.

FIG. 1 is a perspective view showing a head 1 of the sewing machine for automatic thread taking-up operation seen from the side of a face plate 3.

On the top face of the head 1, an arm spool pin 5 and a top thread holder 9 are provided. A bobbin 7 is put on the arm spool pin 5, and a needle thread w from the bobbin 7 is held by the top thread holder 9 and led to the front of the head 1. A guide groove 11 beginning directly before the top thread holder 9 intersects the top face, extends downward in the front face of the head 1, passes under the face plate 3, and ends at the rear of the face plate 3.

On opposite sides of the guide groove 11 on the front face of the head 1, a start switch SW1 and a threading switch SW2 are attached. The start switch SW1 at the lower position initiates the start of the sewing operation. The threading switch SW2 at the higher position starts the thread taking-up operation by a thread take-up and the threading operation to the eye of a needle, both of which are explained later.

Figure 2:
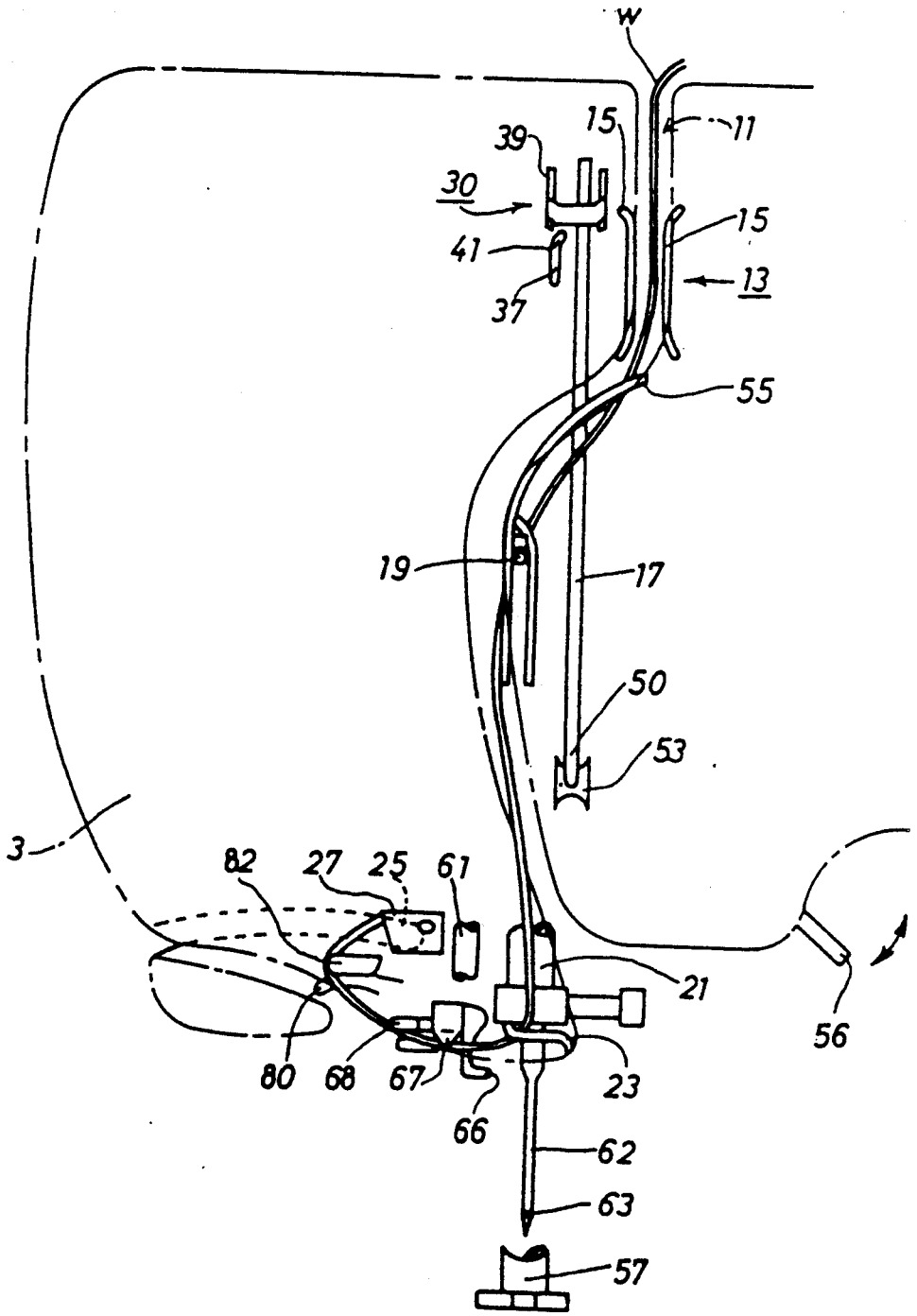
FIG. 2 is a front view of a guide groove of the sewing machine.

As shown in the front view of FIG. 2, the guide groove 11 passes between a pair of tension discs 15 of a tension member 13, obliquely intersects approximately the middle portion of a thread guide 17 above a thread take-up spring 19, and goes around a needle-bar thread guide 23 provided under a needle bar 21. Further, the guide groove 11 passes under the front portion of the face plate 3 and ends at a terminal 25 at the rear of the face plate 3. A thread cutter 27 is attached to the terminal 25 of the guide groove 11.

Figure 3:
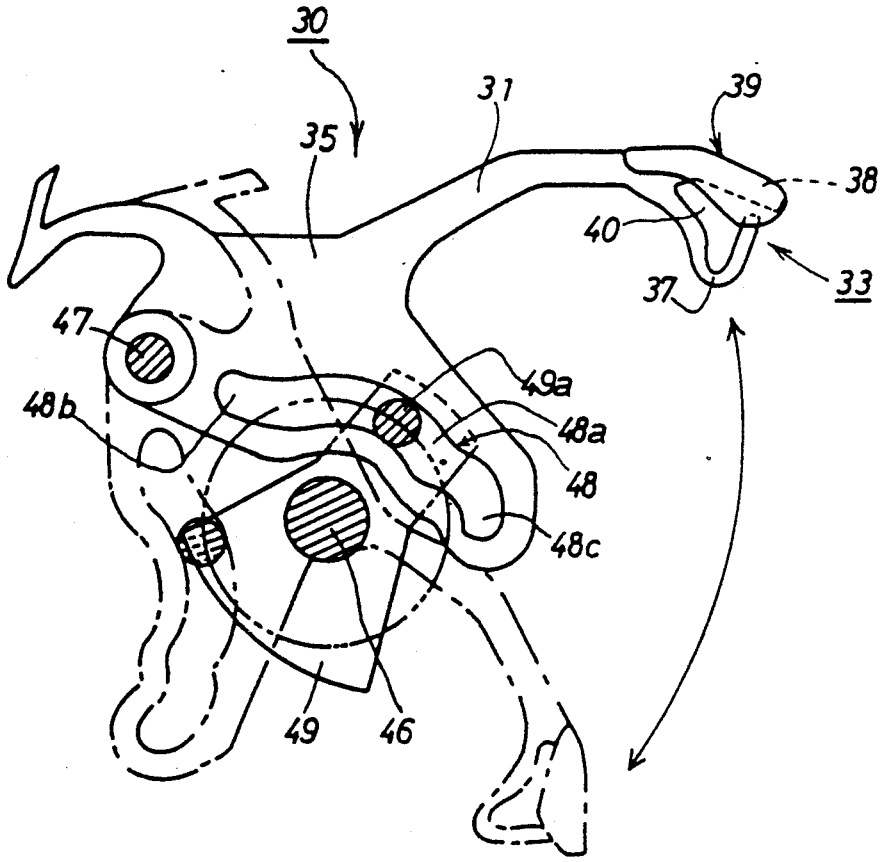
FIG. 3 explains the operation of a thread take-up of the sewing machine.

Inside of the head 1, a thread take-up 30 is provided in the front portion of the guide groove 11 so as to swing vertically in front of the thread guide 17. The thread take-up 30 comprises, as shown in FIG. 3, an arm 31, a thread holding member 33 provided at one end of the arm 31, and a base 35 provided at the other end of the arm 31. The thread holding member 33 is composed of a claw 37 bent upward for catching the needle thread w, a cover rod 38 provided over the claw 31 and extending forward beyond the claw 31, and an upper pressing cover 39 fixed to the cover rod 38. The claw 31 and the pressing cover 39 comprising form a thread holding hole 40. Seen from the face plate 3, the thread holding hole 40 is a slightly curved narrow, forming a closed pathway, as shown in FIG. 4C.

The claw 37 has a bent tip 41, which is slightly bent toward the thread guide 17 and is covered with the pressing cover 39, as shown in FIG. 2.

Figure 4B:
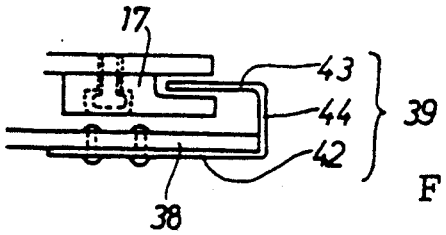
FIG. 4B is a partial top view of the thread take-up.
Figure 4C:
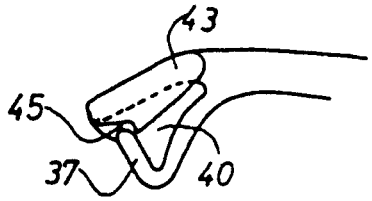
FIG. 4C is a partial rear view of the thread take-up.

The pressing cover 39 is almost U-shaped in cross section as seen from the top and surrounds the thread guide 17, as shown in FIG. 4B. A front side panel 42, a rear side panel 43, and a connecting panel 44 compose the pressing cover 39. The front panel 42 is positioned in front of the thread guide 17 and the rear panel 43 is behind the thread guide 17. The connecting panel 44 connects the front panel 42 and the rear panel 43. The peripheries of the front panel 42, the rear panel 43, and the connecting panel 44 are curved and have no pointed edges. A notch 45 having a corner is formed at the lower end of the rear panel 43, through which the end of the claw 37 sticks out.

As shown in FIG. 3, the base 35 of the thread take-up 30 is rotatably mounted on an auxiliary shaft 47. The auxiliary shaft 47 is parallel with an arm shaft 46. The base 35 has a cam slot 48 in the neighborhood of the auxiliary shaft 46. A crank pin 49*a* of a thread take-up crank 49 fixed to the arm shaft 46 is movable in the cam slot 48. The cam slot 48 has three portions; an arc portion 48*a* in the middle, a linear portion 48*b* at one end near the auxiliary shaft 47, and a short arc portion 48*c* at the other end. The arc portion 48*a* has a curvature approximately equal to that of the partial circle made by the rotation of the crank pin 49*a*. The curvature of the short arc portion 48*c* is smaller than that of the arc portion 48*a*. By the engagement of the cam slot 48 and the crank pin 49*a*, the thread take-up 30 moves as shown by the arrow in FIG. 3 when the arm shaft 46 is rotated. The relative positions of the cam slot 48 and the crank pin 49*a* are adjusted such that the thread take-up 30 goes down beyond a lower end portion 50 of the thread guide 17, as shown by a dashed line in FIG. 4A.

The left edge of the thread guide 17 has approximately the same curvature as that made by the movement of the notch 45 formed at the rear panel 43 of the pressing cover 39 and, therefore, the notch 45 moves following the tracks of the notch 45 at a short distance apart. The left edge of the thread guide 17 and the notch 45 are separated only at the lower end 50 of the thread guide 17.

Figure 4A:
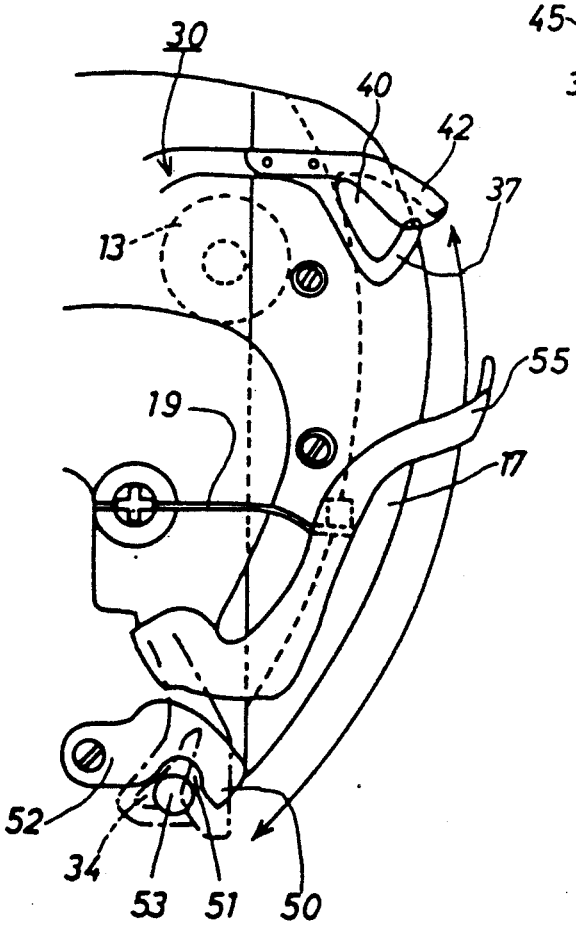
FIG. 4A is a front view of the thread take-up.

Further, at the lower end portion 50 of the thread guide 17 a thread receiver 52 is positioned, as shown in FIG. 4A. The thread receiver 52 has a dent 51 in its lower portion. A press roller 53 provided in the dent 51 is brought close to or apart from the thread receiver 52 by a cam mechanism (not shown) during the sewing operation, thus adjusting the tension of the needle thread w during the sewing operation. A guide member 55 is interposed between the thread take-up 30 and the thread receiver 52 so as to cover the thread take-up spring 19 and a portion of the thread guide 17.

As shown in FIG. 2, near the curved portion of the guide groove 11 at the bottom of the face plate 3, a lower end of a threading member shaft 61 for the threading operation is provided. The following is an explanation of the threading member shaft 61.

The threading member shaft 61 is connected to a thread positioning member 64 and a threading member 65. The thread positioning member 64 strings the needle thread w in front of an eye 63 of a needle 62 by the cooperation of a guide mechanism and a linkage mechanism, described later, when the threading member shaft 61 is vertically moved and then rotated. The threading member 65 introduces the strung needle thread w into the eye 63.

Figure 5:
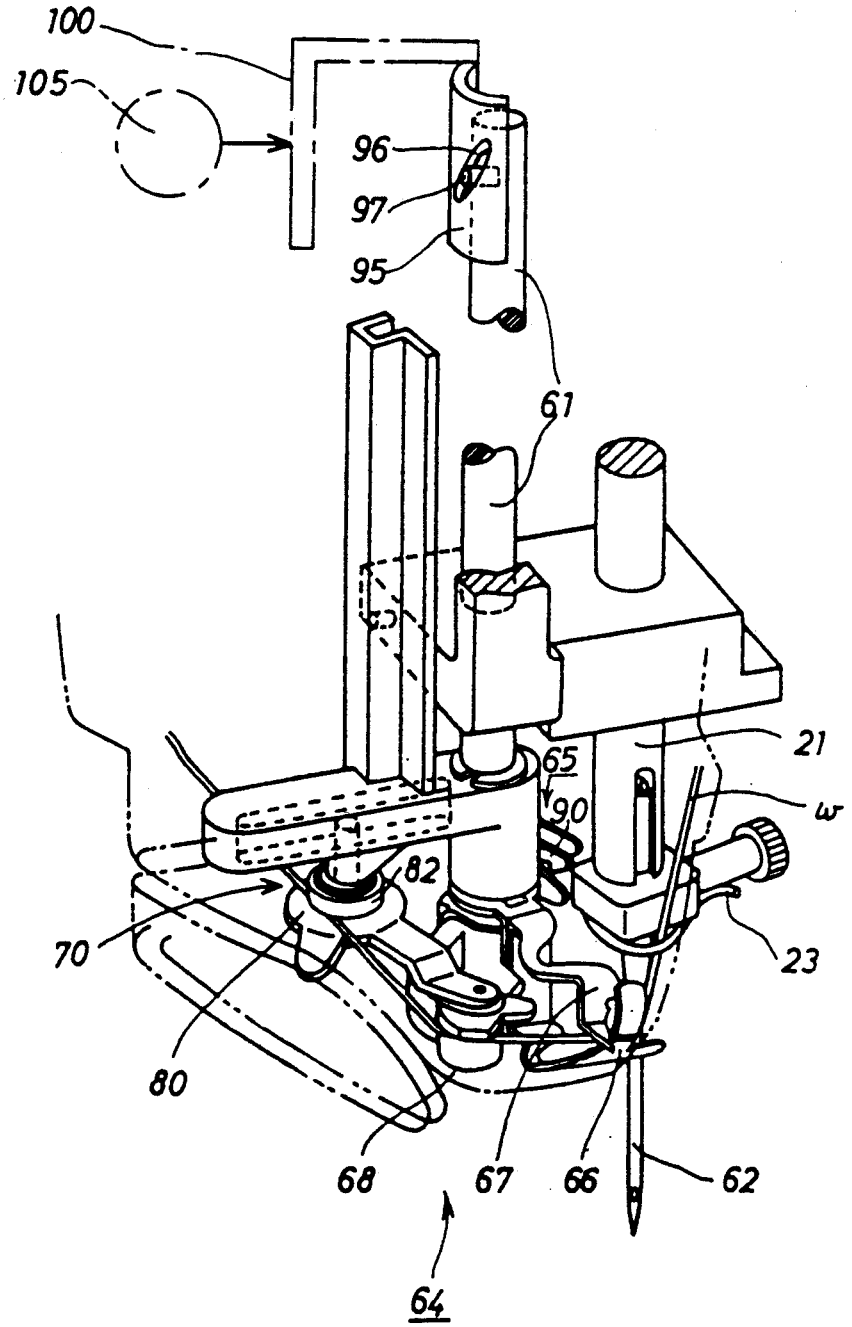
FIG. 5 is a perspective view of a thread positioning member of the sewing machine provided under a threading member shaft.

As shown in FIG. 5, the thread positioning member 64 is composed of a first positioning part 66 provided near the needle-bar thread guide 23, a second positioning part 67 provided behind the first positioning part 66, a third positioning part 68 provided behind the second positioning part 67, and a thread end keeping member 70 provided above and behind the three positioning parts 66, 67 and 68. The thread positioning parts 66, 67 and 68 are almost at the same height. The thread end keeping member 70 is constructed such that the needle thread w is kept between a receiving member 80 and a pressing disc 82 forced downward by a spring.

The threading member 65 is provided opposite to the third positioning part 68 with the threading member shaft 61 therebetween. The third positioning part 68 and the threading member 65 are fixed to the threading member shaft 61. Accordingly, when the threading member shaft 61 rotates, the third positioning part 68 and the threading member 65 are rotated at the same angle and in the same direction as those of the threading member shaft 61.

The threading member shaft 61 is the same as that disclosed in Japan Published Examined Utility Model No. S54-43878. When a guide member 95 moves vertically, the threading member shaft 61 is lowered and then is rotated because a cam slot 96 provided in the guide member 95 and an engagement pin 97 fixed to the upper portion of the threading member shaft 61 are engaged. In this embodiment, the top of the guide member 95 is pressed down by a pressing member 100 moved vertically by a pulse motor 105. The threading member shaft 61 is thus lowered and rotated.

The needle thread w is led to the thread end keeping member 70 along the guide groove 11, crossing the thread guide 17, as follows.

By operating a presser-foot lever 56 provided behind the needle bar 21 on the head 1, a presser foot 57 is raised and the tension member 13 is opened. As shown in FIGS. 1 and 2, the needle thread w is then extracted from the bobbin 7, held by the top thread holder 9, and is led in the guide groove 11 from the front face to the rear face of the head 1. As a result, the needle thread w passes between the tension discs 15 of the tension member 13, is put on by the thread take-up spring 19, and goes through the needle-bar thread guide 23. The needle thread w is further held by the thread positioning member 64. Specifically, the needle thread w passes through the needle-bar thread guide 23, below the first positioning part 66 and the second positioning part 67, and goes around the third positioning part 68. Finally, the needle thread w is kept between the pressing disc 82 and the receiving plate 80 of the thread end keeping member 70.

Subsequently, the threading switch SW2 is pressed and a predefined sewing operation control procedure is performed by the electronic control circuit 120 to accomplish the thread taking-up operation and the threading operation.

Figure 7:
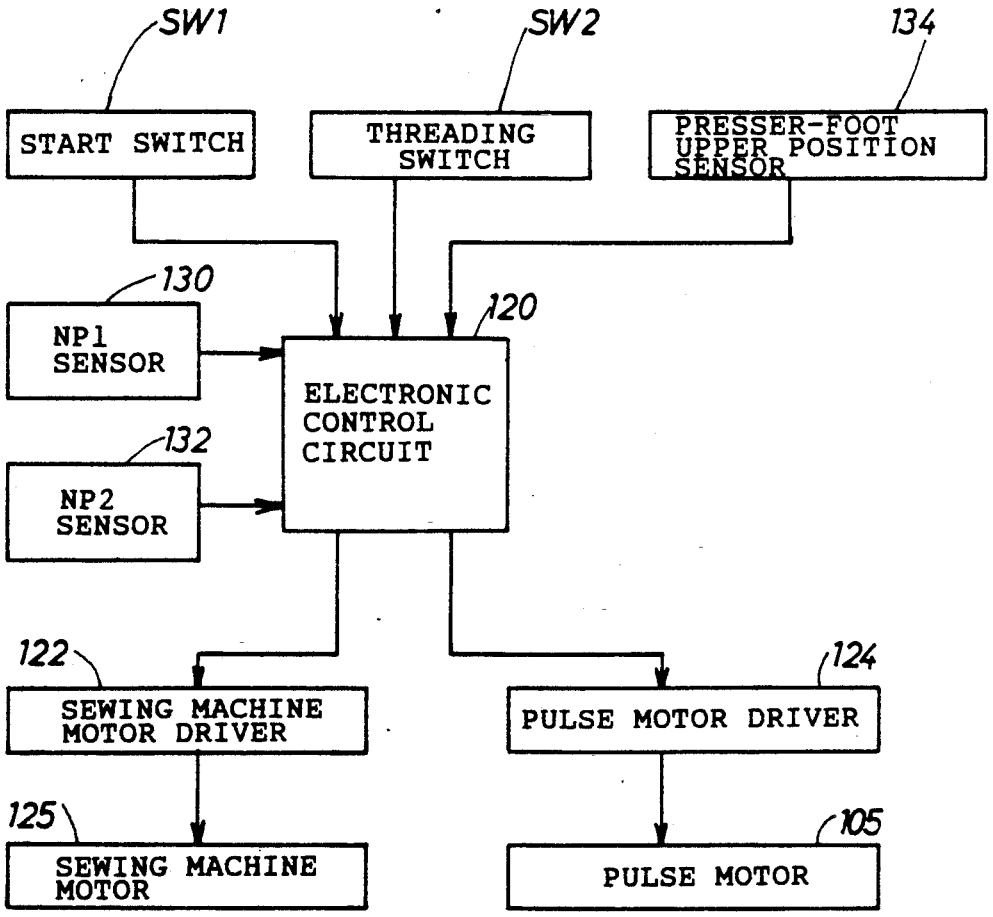
FIG. 7 is a block diagram showing the control system of the sewing machine.

The control system of the sewing machine for the automatic thread taking-up operation and threading operation is described referring to FIG. 7.

The electronic control circuit 120 is a general micro computer comprising a CPU, ROM, RAM, and the like. The start switch SW1 and the threading switch SW2 are connected to the electronic control circuit 120 at its input side, and a sewing machine motor 125 and the pulse motor 105 are connected at its output side via a sewing machine motor driver 122 and a pulse motor driver 124. An NP1 sensor 130 and an NP2 sensor 132 are also connected to the electronic control circuit 120. The NP1 sensor 130 sends out a detection signal when the needle bar 21 is in its highest position (hereafter referred to as the NP1 position) as determined from the phase angle of the arm shaft 46. The NP2 sensor 132 sends out a detection signal when the thread take-up 30 is in its highest position (hereafter referred to as the NP2 position), which is also determined from the phase angle of the arm shaft 46. The NP1 sensor 130 controls such that the thread positioning member 64 and the threading member 65 do not come in contact with the presser foot 57. The NP2 sensor 132 controls the sewing machine motor 125 to stop it when the thread take-up 30 is in the highest position such that the needle thread w smoothly comes out of a bobbin case (not shown) when the sewing operation ends.

Furthermore, a presser-foot upper position sensor 134 is connected to the electronic control circuit 120. The presser-foot upper position sensor 134 sends out a detection signal when the presser foot 57 is raised with the presser-foot lever 56, in other words, when the tension member 13 is opened.

Figure 8:
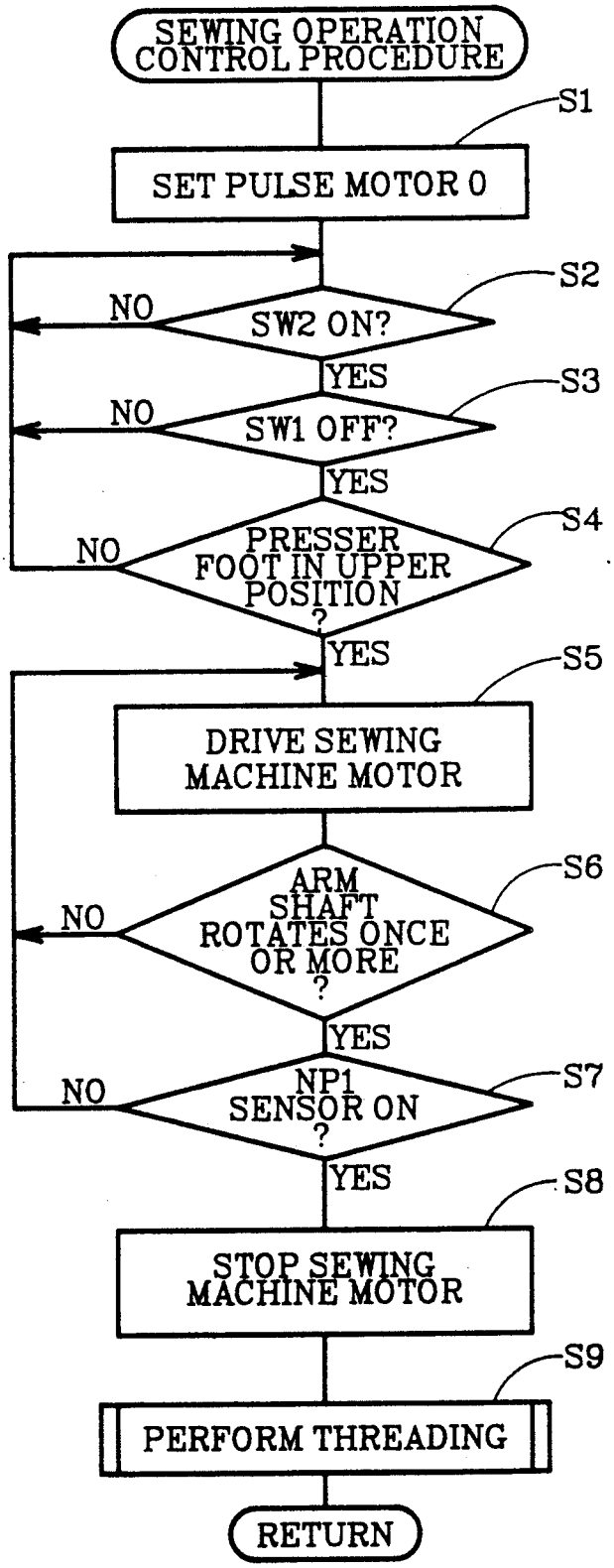
FIG. 8 is a flow chart for a control procedure performed by the control system.

FIG. 8 is a flow chart showing the control procedure executed by the electronic control circuit 120. As described above, the needle thread w extracted from the bobbin 7 is led to a predetermined position along the guide groove 11. When it is turned on, the sewing machine is initialized and its motors, including the pulse motor 105, are set to "0" at step S1.

Subsequently, the threading switch SW2 is pressed. When it is determined at step S2 that the threading switch SW2 is on, it is asked at the next step S3 whether the start switch SW1 is off or not. When the answer is affirmative, the electronic control circuit 120 proceeds to step S4, where it is asked whether the presser foot 57 is in its upper position and the tension member 13 is opened. When the start switch SW1 is on or when the presser foot 57 is not raised, the procedure goes back to step S2. The threading switch SW2 must be pressed again when the answer at step S3 or step S4 is negative, because the threading switch SW2 operates only temporarily.

When the start switch SW1 is off and the presser foot 112 is in its upper position, the sewing machine motor 125 is driven at step S5.

Figure 9A:
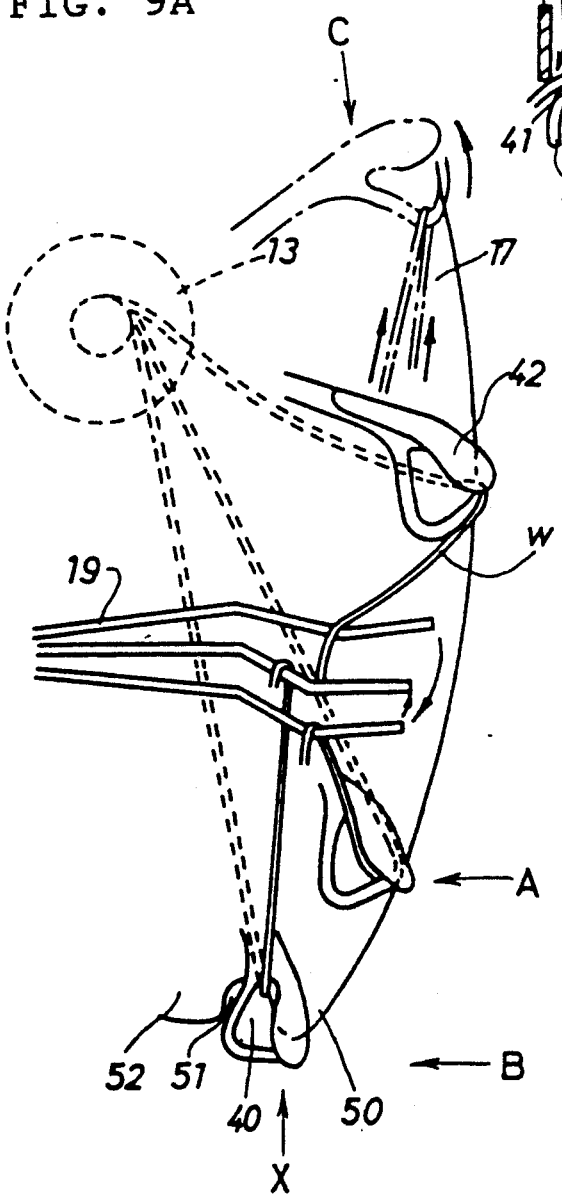
FIGS. 9A through 9C explain the operation of the thread take-up.
Figure 9B:
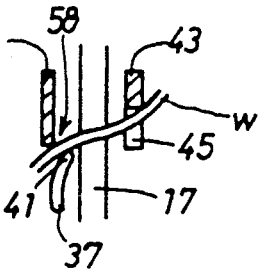
Figure 9C:
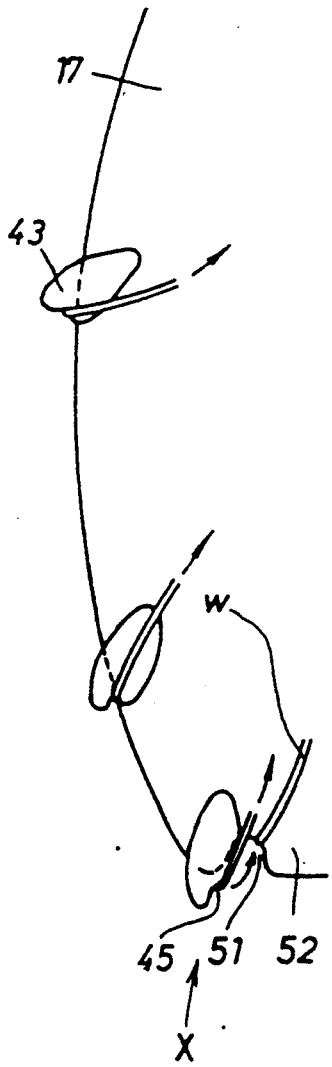

When the sewing machine motor 125 is driven and the arm shaft 46 is rotated, the needle thread w is taken up by the thread take-up 30 swinging up and down along the edge of the thread guide 17, as shown in FIGS. 9A through 9C.

When the thread take-up 30 is swung downward, the needle thread w crossing almost the middle portion of the thread guide 17 is caught by the pressing cover 39 provided at the end of the thread take-up 30. The needle thread w abuts the under sides of the front panel 42 and the notch 45 of the rear panel 43 of the pressing cover 39, and is kept at a pathway 58 between the bent tip 41 of the claw 37 and the front panel 42. The left side of the needle thread w is slightly lower than the right side, as shown in FIG. 9B. The edge of the thread guide 17 and the notch 45 prevent the needle thread w from entering the thread holding hole 40.

As the thread take-up 30 is further swung downward, the thread take-up 30 pulls the needle thread w along the thread guide 17. At this time the needle thread w is effectively pulled only from the bobbin 7 because the free end of the needle thread w is gripped and held by the thread end keeping member 70 and the tension member 13 is opened.

The needle thread w, which is slackened in the guide groove 11 at the beginning, is strung and thus elastically deforms the thread take-up spring 19 downward, as shown by the arrow A in FIG. 9A, and is strained as tightly as during the sewing operation.

As the arm shaft 46 rotates further, the thread take-up 30 reaches a crossing position X below the lower end 50 of the thread guide 17, as shown by the arrow B in FIG. 9A. At the crossing position X, the edge of the thread guide 17 is apart from the notch 45. Therefore, the needle thread w is not prevented from entering the thread holding hole 40. In addition, the thread take-up spring 19 leaps up.

Consequently, the needle thread w passes through the pathway 58 along the curved periphery of the front panel 42 into the thread holding hole 40 and at the same time slips from the notch 45 of the rear plate 43. The needle thread w is put in the dent 51 of the thread receiver 52 and the thread holding hole 40. The lower end 50 of the thread guide 17 is far from the notch 45 at the crossing point X, and the lower end 50 is positioned below the deepest point of the thread holding hole 40. Therefore, the needle thread w held at the deepest point of the thread holding hole 40 never goes up beyond the lower end 50 of the thread guide 17 when the thread take-up 30 swings up by the rotation of the arm shaft 46. Now, the needle thread w is not pressed by the pressing cover 39. Therefore, the needle thread w is moved at the front side of the thread guide 17 as the thread take-up 30 swings and never goes to the rear side of the thread guide 17. The needle thread w is thus kept in the thread holding hole 40 and the thread receiver 52.

While the thread take-up 30 swings, the needle thread w is extracted from the upstream side and the downstream side, as shown by the arrow C. The needle thread w is caught by the thread take-up 30 with almost the same tensile strength as that during the sewing operation because the needle thread w is curved at the thread receiver 52 and the claw 37 is bent approximately 90 degrees in the horizontal direction at the needle bar thread guide 23, and is kept by the thread end keeping member 70. As a result, the needle thread w is strained as tightly as when the needle thread w passes through the eye 63 of the needle 62.

The needle thread w is thus taken by the thread take-up 30. Although the needle thread w is caught by the thread take-up 30 after the thread take-up 30 once swings down, it is asked at step S6 whether the arm shaft 46 rotated once or more such that the needle thread w never fails to be taken regardless of the initial position of the thread take-up 30.

After the sewing machine motor 125 rotates once or more, the phase angle of the arm shaft 40 is NP1. Then, it is determined at step S7 whether the NP1 sensor 130 output a detection signal, indicating that the threading operation was successfully performed. When the answer at step S7 is affirmative, the sewing machine motor 125 is stopped at step S8.

The thread taking-up operation can be executed while the thread take-up 30 moves up and down at steps S6 and S7, even when the thread take-up 30 is in the lower position at the beginning. After the thread taking-up operation is finished, the pulse motor 105 is driven to perform the threading operation at step S9.

Figure 6A:
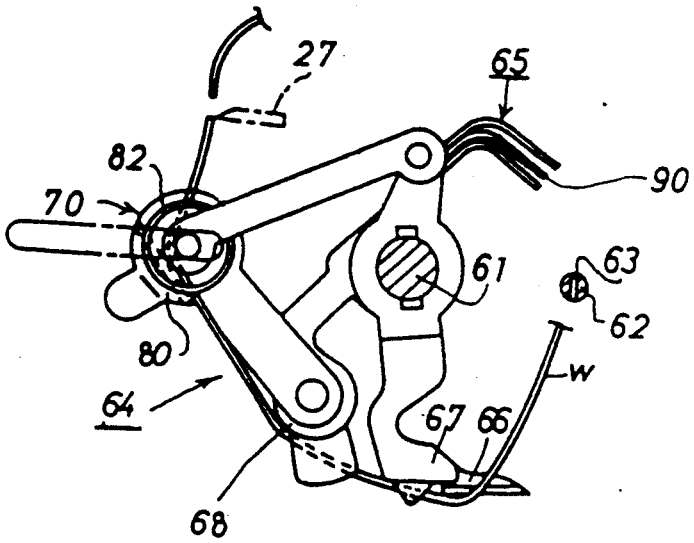
FIGS. 6A through 6C are top views showing the operation of the thread positioning member.
Figure 6B:
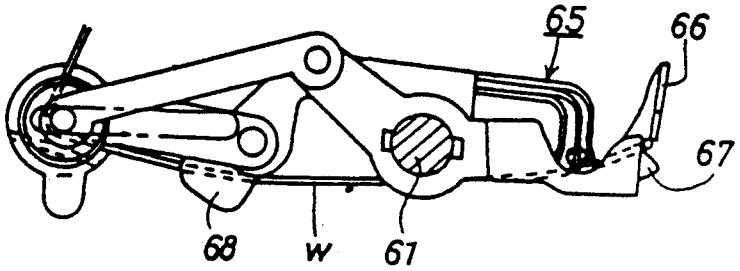
Figure 6C:
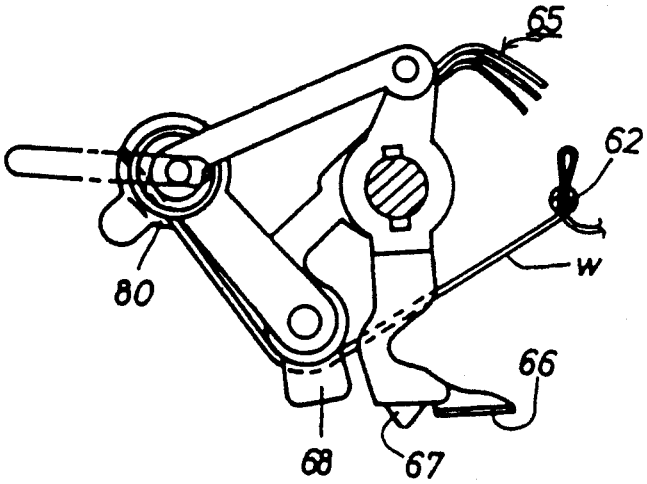

The threading operation is briefly explained hereafter with reference to FIGS. 6A through 6C.

As described above, when the pulse motor 105 rotates forward, the threading member shaft 61 is lowered. After a threading hook 90 is just beside the eye 63, the threading member shaft 61 is stopped being lowered and is rotated, due to the cam hole 96. Consequently, the thread positioning member 64 is stretched out and the first and the second positioning parts 66 and 67 are positioned at the right of the needle 62, as FIG. 6B is viewed. As a consequence, the needle thread w is strung in front of the eye 63 of the needle 62.

At the same time, the threading member 65 is also rotated and the threading hook 90 passes through the eye 63. The needle thread w is caught by the threading hook 90 and the threading hook 90 comes out of the eye 63 by the reverse rotation of the pulse motor 105. At this time the needle thread w is extracted from both the upstream side and the downstream side in almost the same amount. At the downstream side, the needle thread w is slipped from between the receiving plate 80 and the pressing disc 82; and on the other hand, at the upstream side the needle thread w is tightly strung between the claw 37 and the eye 63. After the threading operation, the needle thread w is positioned between the thread take-up 30 and the eye 63 with appropriate tension.

As described above, in this embodiment the operator has only to guide the needle thread w along the guide groove 11 and to press the threading switch SW2. He does not have to hang the needle thread w to the thread take-up 30 nor the thread receiver 52.

Since the thread take-up 30 catches the needle thread w when swinging up and down, another component only for the thread taking-up operation is not required. In addition, the needle thread w taken up by the swinging thread take-up 30 is strung in almost the same condition as that when the sewing operation begins. Therefore, the initial stitches are not mis-formed at the beginning of the sewing operation.

The thread guide 17 is formed along the moving area of the thread take-up 30 such that the needle thread w is securely led to the thread receiver 52 beyond the crossing position X. The pressing cover 39 surrounding the thread guide 17 and the notch 45 of the rear panel 43 help the needle thread w to be taken without fail.

Further, the thread holding hole 40 formed by the claw 37 and the pressing cover 39 is positioned above the lower end 50 of the thread guide 17. The needle thread w once caught in the thread holding hole 40 never crosses the thread guide 17 from the inside to the front side of the head 1. At this time, the needle thread w is detached from the rear panel 43 of the pressing cover 39 and the needle thread w does not go beyond the thread guide 17. Consequently, the needle thread w taken by the thread receiver 52 and the thread holding hole 40 is not easily slipped from the thread receiver 52 and the thread holding hole 40.

The upper periphery of the pressing cover 39 is curved such that the needle thread w is not carried up on the pressing cover 39 even when the thread take-up 30 in a lower position first swings up by the rotation of the arm shaft 46. Further, the sewing machine motor 125 is stopped after the arm shaft 46 rotates once or more and the needle bar 21 is in the NP1 position. Thus, the thread taking-up operation never fails to be performed irrespective of the initial position of the thread take-up 30.

The prior art, namely Japan Published Unexamined Patent Application No. S47-19948 and Japan Published Examined Utility Model Application No. S63-228 have a problem. Specifically, when the needle thread is not securely held by the thread positioning member for the thread taking-up operation provided in the thread take-up moving area, the needle thread may not be caught sometimes by the end of the thread take-up because the needle thread is pushed away by the thread take-up. Therefore, the operator must carefully put the needle thread on the thread positioning member before the thread taking-up operation.

In the above-described embodiment of this invention, the thread take-up 30 does not push away the needle thread w. Even when the thread take-up 30 is initially in the lower position, the needle thread w is slipped off from the thread take-up 30 when the thread take-up 30 swings up. The thread take-up 30 can catch the needle thread w that is slackened along the guide groove 11. As a result, the operation for preparing the needle thread w is much easier and more reliable than in the prior art machines.

Owing to the cam slot 48, the thread take-up 30 swings up at high speed and can quickly take up the needle thread w after passing beyond the lower end 50 of the thread guide 17. The needle thread w is not slackened in the vicinity of the crossing position X. Thus, the needle thread w is securely caught by the thread holding hole 40 and the thread receiver 52.

During the thread taking-up operation, the needle thread w is pulled from the upstream side because the tension member 13 at the upstream side is opened and the thread end keeping member 70 at the downstream side pinches and holds the free end of the needle thread w. The end of the needle thread w at the downstream side does not come out of the thread end keeping member 70 and is never pulled backward through the needle-bar thread guide 23. The amount of the needle thread w between the thread take-up 30 and the needle 62 is not reduced during the thread taking-up operation.

Other components can prevent the backflow of the needle thread w. For example, a holding member like a tension disc may be provided between the thread take-up 30 and the needle bar thread guide 23.

As described above, the needle thread w is prevented from flowing backward and is taken by the thread take-up 30 with appropriate tension, and the thread taking-up operation and the threading operation are performed automatically. Accordingly, the operator can begin the sewing operation right after guiding the needle thread w along the guide groove 11—and neat stitches can be formed immediately.

. The needle thread w is easy to enter and difficult to go out of the thread holding hole 40 because the tip 41 of the claw 37 of the thread take-up 30 is slightly bent. Therefore, even when the deepest point of the thread holding hole 40 does not have to be always above the lower end 50 of the thread guide 17, the needle thread w does not easily escape from the thread holding hole 40. Other means for preventing the needle thread w from slipping from the thread holding hole 40 can be adopted. For example, a claw 37 with a further bent tip can be used.

The thread take-up spring 19 at the downstream side of the thread take-up 30 lifts the needle thread w such that the needle thread w goes beyond the lower end 50 of the thread guide 17 easily. However, the lower end 50 and the tension member 13 is positioned such that the needle thread w may cross the lower end 50 without the thread take-up spring 19. Consequently, the thread take-up spring 19 may be positioned at the upstream side of the thread take-up 30 or may be formed integrally with the thread receiver 52.

Although the edge of the thread guide 17 is similar to the moving area of the thread take-up 30, only the notch 45 can bring the needle thread w to the crossing position X. Accordingly, the thread guide 17 may be formed apart from the moving area of the thread take-up 30. In this case, the needle thread w is caught in the thread holding hole 40 at some point within the moving area of the thread take-up 30 and the notch 45 carries the needle thread w to the crossing position X.

All the thread take-up 30 has to do is to abut the needle thread w and carry the needle thread w to the crossing position X. The thread take-up 30 does not have to swing around the arm shaft 47.

Figure 10A:
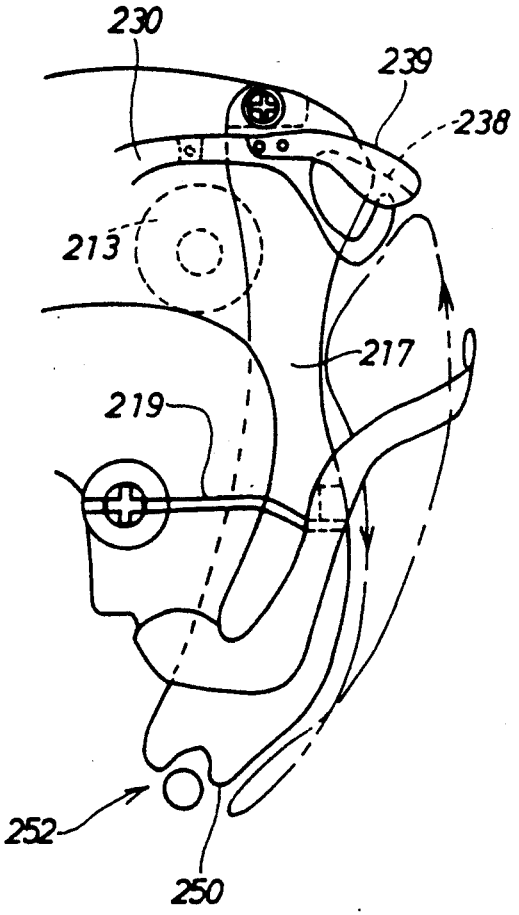
FIG. 10A is a front view of the thread take-up of a sewing machine according to this invention in a second embodiment.
Figure 10B:
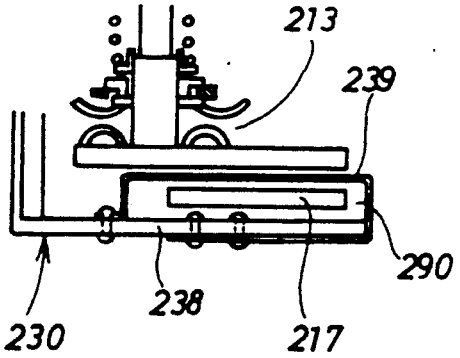
FIG. 10B is a partial top view of the thread take-up.

In FIGS. 10A and 10B, another thread take-up 230 according to a second embodiment of the present invention is shown. The thread take-up 230 rotates around a crank pin (not shown) of a thread take-up crank (not shown) by a link mechanism (not shown) describing an 8-sided track.

The thread take-up 230 is moved by a mechanism different from that of the first embodiment and swings describing the 8-sided track, as shown by the arrow in FIG. 10A. The edge of a thread guide 217 is formed to follow the moving area of the thread take-up 230. Other functions are the same as those of the thread take-up 30 of the first embodiment. Specifically, the needle thread w is carried to a crossing position X, overcomes a lower end 250 of the thread guide 217 owing to the position of a tension member 213 and the operation of a thread take-up spring 219, and held by a thread receiver 252. A pressing cover 239 is formed in an almost 0-shape in cross section and attached to a cover rod 238 of the thread take-up 230 such that the thread guide 217 is surrounded in a rectangular pathway 290 of the pressing cover 239.

In the second embodiment, the operator has only to introduce the needle thread w along a guide groove (not shown), as shown in the first embodiment. The needle thread w is caught by the thread receiver 252 and the thread take-up 230 easily.

Although two embodiments have been described, the present invention is not to be limited to these embodiments; but, includes all embodiments and modifications within the scope and spirit of the invention. For example, the pressing cover 39 and 239 may be left out and the cover rod 38 and 238 may carry the needle thread w to the crossing position X. Further, the thread take-up 30 and 230 do not have to swing up and down. A thread take-up which oscillates horizontally can be adopted, for example.

Wherefore, having thus described the invention, what is claimed is:

1. In a sewing machine having a sewing head carrying a needle bar driven by a sewing motor and having a sewing needle with an eye therethrough mounted on a bottom end for motion therewith, automatic thread taking-up apparatus comprising:

a) needle thread guide means for guiding a needle thread from a needle thread supply source to a threading position in the vicinity of the needle bar via a thread taking-up position, said needle thread guide means obliquely intersecting a thread take-up moving area at said thread taking-up position;

b) thread taking-up means moving through said thread take-up moving area for extracting said needle thread at said thread taking-up position, said thread taking-up means including a thread taking-up member for taking-up a loop of needle thread, said thread taking-up member including a projecting member with a thread holding portion having a pathway formed therein through which needle thread enters said thread holding portion and a blocking member for preventing needle thread having entered said thread holding portion through said pathway from slipping out of said thread holding portion;

c) signal generating means provided in association with the sewing machine for generating signals when operated by a human operator; and, d) thread taking-up control means for controlling said thread taking-up means in response to signals from said signal generating means whereby said thread taking-up member automatically takes up said loop of needle thread after needle thread has been pulled through said needle thread guide means from said needle thread supply source to said threading position.

2. The sewing machine including provision for an automatic thread taking-up operation of claim 1 wherein:

a) said projecting member rotates vertically about an inner end thereof; and, b) said thread holding portion is carried by an outer end of said projecting member.

3. The sewing machine including provision for an automatic thread taking-up operation of claim 2 wherein:

said thread holding portion comprises a downward-facing claw carried by said an outer end of said projecting member.

4. The sewing machine including provision for an automatic thread taking-up operation of claim 3 wherein:

said claw includes a lower J-shaped hook for holding thread and an upper cover comprising said blocking member.

5. The sewing machine including provision for an automatic thread taking-up operation of claim 4 wherein:

said upper cover includes a side portion extending over one side of an upper end of said J-shaped hook to prevent needle thread having entered said J-shaped hook over said upper end thereof from slipping back out over said upper end thereof.

6. The sewing machine including provision for an automatic thread taking-up operation of claim 5 wherein:

said side portion extending outward past said upper end of said J-shaped hook and is shaped to grab needle thread sliding along a front portion of said J-shaped hook towards said upper end and urge it over said upper end into a space behind said upper end whereby taking-up of needle thread may occur in a substantially consistent manner.

7. The sewing machine including provision for an automatic thread taking-up operation of claim 1 and additionally comprising:

crossing member means for helping needle thread carried beyond said thread taking-up member to cross said needle thread guide means.

8. The sewing machine including provision for an automatic thread taking-up operation of claim 7 wherein:

said crossing member means comprises a spring-biased member.

9. In a sewing machine having a sewing head carrying a needle bar driven by a sewing motor and having a sewing needle with an eye therethrough mounted on a bottom end for motion therewith, automatic thread taking-up apparatus comprising:

a) a thread taking-up member provided at one end of a thread guide;

b) a thread holding member carried by an outer end of an arm in a swinging operation of said arm about an inner end thereof, said thread holding member comprising a projecting member projecting beyond said outer end of said arm; and, c) needle thread carrying means for introducing a needle thread into said thread holding member when said thread holding member swings toward an opposite end of said thread guide and a portion of said needle thread intersecting said thread guide abuts said projecting member; and additionally comprising, d) a pathway formed in said thread holding member through which said portion of said needle thread enters said thread holding member; and, e) a blocking member for preventing said portion of said needle thread once having entered said thread holding member through said pathway from slipping back out of said thread holding member through said pathway.

10. The automatic thread taking-up apparatus for a sewing machine of claim 9 and additionally comprising:

a crossing member for helping needle thread carried beyond said thread taking-up member to cross said thread guide.

11. The automatic thread taking-up apparatus for a sewing machine of claim 10 wherein:

said crossing member comprises a spring-biased member.

12. The automatic thread taking-up apparatus for a sewing machine of claim 9 wherein:

a) said arm rotates vertically about an inner end thereof; and, b) said thread holding portion is carried by an outer end of said arm.

13. The automatic thread taking-up apparatus for a sewing machine of claim 12 wherein:

said thread holding member comprises a downward-facing claw carried by said outer end of said arm.

14. The automatic thread taking-up apparatus for a sewing machine of claim 13 wherein:

said claw includes a lower J-shaped hook for holding thread and an upper cover comprising said blocking member.

15. The automatic thread taking-up apparatus for a sewing machine of claim 14 wherein:

said upper cover includes a side portion extending over one side of an upper end of said J-shaped hook to prevent needle thread having entered said J-shaped hook over said upper end thereof from slipping back out over said upper end thereof.

16. The automatic thread taking-up apparatus for a sewing machine of claim 15 wherein:

said side portion is extending outward past said upper end of said J-shaped hook and is shaped to grab needle thread sliding along a front portion of said J-shaped hook towards said upper end and urge it over said upper end into a space behind said upper end whereby taking-up of needle thread may occur in a substantially consistent manner.

17. In a sewing machine having a sewing head carrying a needle bar driven by a sewing motor and having a sewing needle with an eye therethrough mounted on a bottom end for motion therewith, automatic thread taking-up apparatus comprising:

a) a thread taking-up member provided at one end of a thread guide;

b) a thread holding member carried by an outer end of an arm in a swinging operation of said arm about an inner end thereof, said thread holding member comprising a projecting member projecting beyond said outer end of said arm, said thread holding member comprising a downward-facing claw carried by said an outer end of said arm, said claw including a lower J-shaped hook for holding thread, a pathway formed in said thread holding member through which a portion of a needle thread enters said thread holding member, and an upper cover comprising a blocking member for preventing said portion of said needle thread once having entered said thread holding member through said pathway from slipping back out of said thread holding member through said pathway; and, c) needle thread carrying means for introducing a needle thread into said thread holding member when said thread holding member swings toward an opposite end of said thread guide and a portion of said needle thread intersecting said thread guide abuts said projecting member.

18. The automatic thread taking-up apparatus for a sewing machine of claim 17 wherein:

a) said upper cover includes a side portion extending over one side of an upper end of said J-shaped hook to form said blocking member; and, b) said side portion further extends outward past said upper end of said J-shaped hook and is shaped to grab needle thread sliding along a front portion of said J-shaped hook towards said upper end and urge it over said upper end into a space behind said upper end whereby to comprise said needle thread carrying means and taking-up of needle thread may occur in a substantially consistent manner.

19. The automatic thread taking-up apparatus for a sewing machine of claim 17 and additionally comprising:

a crossing member for helping needle thread carried beyond said thread taking-up member to cross said thread guide.

20. The automatic thread taking-up apparatus for a sewing machine of claim 19 wherein:

said crossing member comprises a spring-biased member.

* * * * *